US006860045B1

(12) United States Patent
Sadler et al.

(10) Patent No.: US 6,860,045 B1
(45) Date of Patent: Mar. 1, 2005

(54) METHOD AND SYSTEM OF MANUFACTURING SPECIAL EVENT MEMENTOS

(76) Inventors: Edward J. Sadler, 225 Towergate Pl., Atlanta, GA (US) 30350; Elizabeth M. Arthur, 1085 Saratoga La., Lake Geneva, WI (US) 53147; Ronald A. Arthur, 1085 Saratoga La., Lake Geneva, WI (US) 53147

( * ) Notice: Subject to any disclaimer, the term of this patent is extended or adjusted under 35 U.S.C. 154(b) by 162 days.

(21) Appl. No.: 10/087,655

(22) Filed: Mar. 1, 2002

(51) Int. Cl.[7] ..... A44C 3/00
(52) U.S. Cl. ..... 40/1.5; 40/661; 40/626
(58) Field of Search ..... 40/1.5, 661, 771, 40/773, 774, 626; 283/109, 110, 111

(56) References Cited

U.S. PATENT DOCUMENTS 4,190,691 A 2/1980 Kramer
4,979,619 A 12/1990 Hager
5,415,902 A 5/1995 Stryker, Jr.
5,608,203 A * 3/1997 Finkelstein et al. ..... 235/487
6,173,514 B1 1/2001 Peterson
6,322,655 B1 * 11/2001 Casagrande ..... 156/257

* cited by examiner

*Primary Examiner*—Cassandra H. Davis
(74) *Attorney, Agent, or Firm*—Boyle Fredrickson Newholm Stein & Gratz S.C.

(57) ABSTRACT

A memento and a process for manufacturing mementos is disclosed wherein a rectangular laminated sheet is created by face-mounting a color graphic print to an acrylic sheet with an optically-clear adhesive. Then, the laminated sheet is precision-divided into a plurality of discrete mementos with full-bleed imagery conforming to the size and shape of the sub-images comprising said graphic print. Also disclosed are: (i) methods for customizing such mementos with company logos, individual names, or other information; (ii) a first embodiment in the form of a name badge with a removable film backing and finding that permits the user to easily detach the finding from the back of the badge and utilize the remainder as a personalized key fob or luggage tag; and (iii) other embodiments in the form of golf bag tags, name tags, award plaques, photo frames, and mounting boards for physical totems and memorabilia.

15 Claims, 18 Drawing Sheets

10
68
70

38
20
9
9
10
66
68
38

64
46
62
66
44
22
24

70
20
78
38
40
89

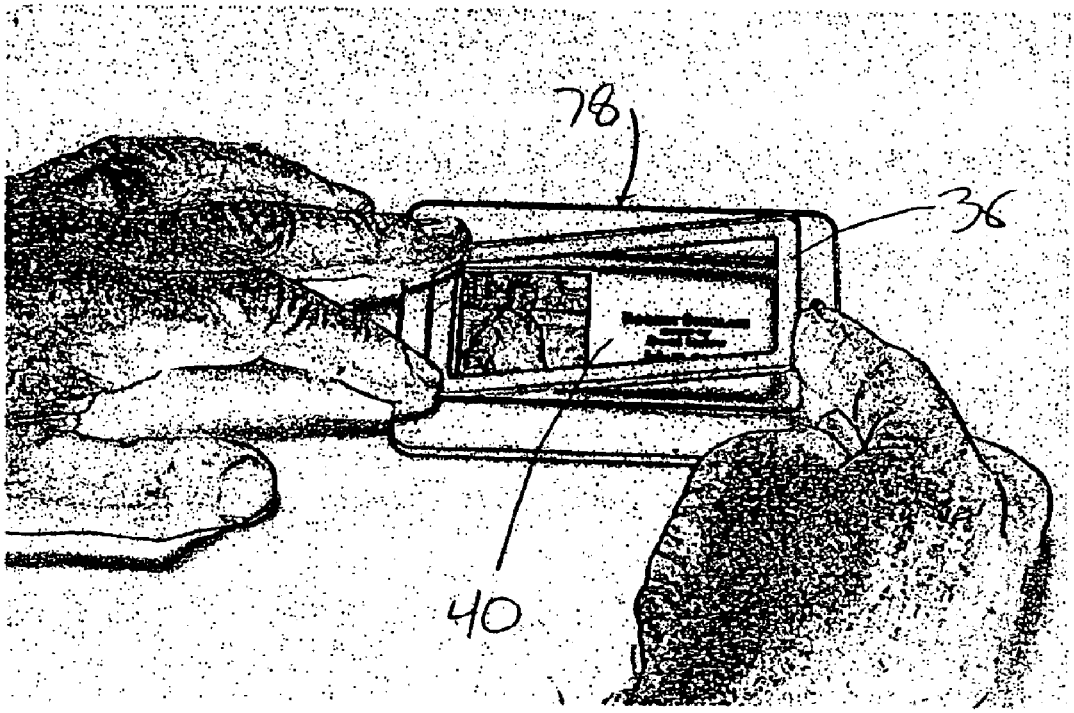
14D

METHOD AND SYSTEM OF MANUFACTURING SPECIAL EVENT MEMENTOS

BACKGROUND OF THE INVENTION

1. Field of the Invention

The present invention relates generally to the art of mementos and physical objects that are emblematic and reminiscent of an individual's attendance at an event or location of significance, including souvenirs, memorabilia, remembrances, totems, keepsakes, and the like. More specifically, the present invention relates to the special events, group entertainment, and meeting industries, where the professional meeting-planners who organize and orchestrate such events can utilize customized embodiments of the invention to enhance the experience of participants and establish favorable impressions and recollections in the minds of attendees, which in turn benefit the hosts and sponsors of such events.

Mementos, souvenirs, keepsakes and the like are well known in commerce and are widely available in settings where businesses serve the tourist trade. While the disclosed invention has general applicability in the tourism industry, its principal application is perceived to be in the segment of the special-events market served by professionals known as "meeting planners". Such professionals—acting as on-staff corporate employees of the event sponsors, as on-staff corporate employees of the host venue, or as independent consultants—organize and orchestrate special events such as seminars, conventions, training sessions, business meetings, golf outings, concerts, theatrical productions, spectator sport events, participatory sporting events, vacation travel tours, incentive travel trips, casino visits, ocean cruises, festivals, reunions, weddings, parties, and similar events with the objective of making the experience pleasant and memorable for the attendees in order to establish good will in the minds of the attendees towards the event sponsor.

One aspect of the meeting and special event industry that has experienced a dramatic increase in sophistication in recent years is the development of custom graphics. This is attributable in part to the advances in computer technology that have enabled professional publishers of books, magazines, videos and other media to create and distribute high-quality and specifically-customized graphics at a greatly reduced cost, compared to prior methodologies. This has increased consumer expectation for these types of graphics. Also, personal computer and inkjet printer technology has made relatively sophisticated graphic capabilities available to the mass market in real time.

As a result, with regard to mementos, people have come to expect short-lead-time and even real-time personalization and customization of mementos that contain high-quality graphic images, but are nevertheless priced economically. The specified invention uniquely satisfies those market demands. Items suitable for manufacture using this method include name badges, key fobs, luggage tags, golf bag tags, ticket-stub savers, photo frames, signs, displays, award plaques, and similar items, particularly those that are intended to create a favorable impression in the minds of participants in special events such as those described above.

2. Discussion of the Related Art

The term "memento" is used herein to refer to devices such as: souvenirs, keepsakes, remembrances, emblems, name badges, key fobs, plaques, awards, signs, displays, golf bag tags, luggage tags, photo frames, memorabilia, collectible preservation/display cases, or the like.

Typically, mementos do not serve any utilitarian function. Conversely, name badges—especially the "temporary" and disposable badges typically used at meetings and special events—usually serve a utilitarian function, but are not valued by those who wear the badges as desirable mementos of the occasion.

U.S. Pat. No. 6,173,514, (the '514 patent) discloses name badges produced by using a small printer which prints typographical graphics on the adhesive side of a transparent pressure-sensitive adhesive tape. These name badges do not, and are not intended to, display high quality full-color/full-bleed graphic images by utilizing the herein-described face-mounting and laser-cutting processes. The badge production techniques described in the '514 patent require users to have access to a specialized printer capable of printing graphics on the adhesive side of a self-adhering transparent tape.

Further, the name badges described in the '514 patent are in the nature of "permanent" or re-usable name badges, described in contradistinction to temporary name badges or "name tags." Commercial custom and practice dictate that permanent and re-usable name badges are purchased only for an organization's personnel who regularly deal with an ever-changing consumer clientele. Such personnel have an ongoing need for indicia of personal identification, and a re-usable name badge that costs 10 to 50 times the cost of a temporary name tag can make economic sense only if it is re-used 10 to 50 times more than a temporary, disposable name tag. Also, permanent and re-usable name badges generally are more attractive in appearance than temporary name tags—and thus create a more favorable impression on an organization's consumer clientele—because such badges are made of more durable materials and are made using more sophisticated manufacturing techniques that are not usually cost-justified for temporary applications.

With respect to mementos used as display plaques, reference is made to U.S. Pat. No. 5,415,902 (the '902 patent), which describes a display plaque comprised of a back plate which serves as a substrate for two or more integrated workpieces, at least one of which is transparent and one of which is opaque, the two of which workpieces coincide and are joined along at least one side. The display plaque disclosed in the '902 patent is characteristic of all other plaques and signs described in the prior art where the personalization of the plaque is accomplished by engraving, painting, or silkscreening the front-facing or outward-facing surface of an opaque material or by attaching one or more previously engraved, painted or silkscreened member(s) to the front-facing or outward-facing surface of such plaque.

While the plaque of the '902 patent describes the inclusion of indicia at the rear surface of the transparent workpiece member, it does not contemplate face-mounting lamination. The inventors now realize that face-mounting lamination would be desirable because it permits an aperture to be cut in the full-color graphic itself (as well as through the entire laminated face-piece) prior to the attachment of the face-piece to a backplate. The resulting aperture could provide a location within the display plaque of the precise size and shape of a standard adhesive-backed label. The plaque therefore could be customized or personalized in real time by the end-user employing an ordinary computer printer, without need to resort to the difficult and expensive engraving, painting and/or silkscreen methods described in the '902 patent.

Reference also is made to U.S. Pat. No. 4,190,691 (the '691 patent), which describes a trophy plaque that includes a recess suitable for the insertion of an adhesive-backed label with alphanumeric or graphic indicia, and a corresponding press-fitted lens. The methodology of forming the trophy plaque disclosed does not contemplate the integration of the label into an acrylic surface defined by a full-color/full-bleed face-mounted graphic image. More specifically, while the '691 patent describes a press-fitted decorative member as one element of the trophy plaque, it contemplates a standard decorative surround in the nature of a "picture frame molding" to enhance the visual importance of the graphic insert, as opposed to physical totems of remembrance and/or physical memorabilia.

In this connection, reference is also made to U.S. Pat. No. 4,979,619 (the '619 patent), which describes a protective case for collectible sports cards. The '619 patent describes a method for encapsulating a printed item of memorabilia within transparent acrylic for purposes of preservation and display. However, the '619 patent, and similar products disclosed in the prior art do not integrate the collectible sports card or other printed totem of remembrance into a display plaque that enhances the appearance of the sports card or totem by surrounding it with a related full-color/full-bleed graphic image.

One primary shortcoming common to all mementos disclosed in prior art is the lack of any inexpensive, yet visually attractive, method for personalizing mementos with the name of the purchaser or recipient. The various means of personalizing characteristic of previous mementos as disclosed in the prior art are: (i) engraving; (ii) attaching an embossed adhesive label to the surface of the item; or (iii) attaching a regular adhesive label to the surface of the item. With regard to these means of personalizing, engraving is an expensive technique, suitable primarily to metal or wooden products and surface-mounted labels are unattractive and are associated in the minds of consumers with "cheap" merchandise. Also, no previous mementos have utilized an optically-clear lens to "encapsulate" a label, protecting it from possible damage and adding vibrance and luster to the label.

Another primary short-coming common to all name-badges as disclosed in the prior art is that the badges either are inexpensive "temporary" badges printed on paper (sometimes inserted into a thin plastic "jacket" with a "safety-pin" finding) or paper backed with pressure-sensitive adhesive; or they are "permanent" badges (such as those used to identify food-service waiters and waitresses) to be used by the same person repeatedly on multiple occasions. Temporary badges could be printed with graphic images because they were printed on paper; but permanent badges could be enhanced at best with a simple logotype of one or two colors, with no photographic range of colors, because the enhancement was produced using engraving or silkscreening technologies.

OBJECTS AND SUMMARY OF THE INVENTION

One object of the present invention is to provide a method of manufacturing various types of mementos that have far more visual appeal than similar products made without full-color/full-bleed graphic images. Until now, there has been no economical way to produce mementos containing integral high-quality graphic images with a photographic range of colors, because of the limitations characteristic of the previously most sophisticated technique for attaching color images to rigid and semi-rigid surfaces—known as "silk screening".

Another object of this invention is to provide a manufacturing technique that produces name badges that are less expensive but more visually appealing than all "permanent" name badges described in the prior art.

And, with the addition of a removable film backing, the object of one preferred embodiment of this invention is to provide a "convertible" name badge that serves temporarily as a name-badge, and then is converted to permanent use thereafter as a key fob or luggage tag. In doing so, the invention allows the sponsor or host of a function or special-event to provide a "temporary" name-badge with an appearance superior in quality normally associated with "permanent" name badges. Furthermore, the invention's flexibility, in converting from a name-badge to a key fob or luggage tag, adds a dimension of utility omitted from all name-badges described in the prior art.

The disclosed invention thus differs in several important respects from the prior art and all commercially-available name badges pre-dating the invention:

(a) The invention results in name badges made of durable materials like permanent and re-usable name badges, but allows users to easily and inexpensively customize the badges with self-printed labels similar to the practice typical for inexpensive temporary name tags;

(b) The invention's label-based personalization is combined with a transparent snap-in lens to encapsulate the label on the same plane as the face-mounted graphic image, thus producing the same deep luster and vivid visual appearance for the personalized label as exists for the corresponding graphic image, and thereby resulting in a visual effect that implies the personalized label is an integral part of the surrounding image;

(c) Economical production processes dictate that name badges produced using the invention are only slightly more expensive than temporary name tags (i.e. 2 or 3 times the retail price) but have quality and appearance features typical only of the more expensive permanent name badges, thus making it economically viable to use "permanent" name badges in "temporary" applications like weddings, meetings, and other special events;

(d) The use of an optically-clear adhesive film, with a removable plastic film backing, to secure the lens in place over the personalization label inserted by the end user results in a bond that is much stronger than a mere mechanical snap-in lens could accomplish, thus making items produced using the invention suitable for rough-use applications like golf bag tags, key fobs, and luggage tags.

(e) Production processes that permit the inexpensive introduction of full-color/full-bleed photographic quality images in re-usable name badges applications that typically are characterized by only one or two solid colors, make badges produced using the invention more attractive to users and their consumer clientele than limited-color or bordered-image permanent name badges, and thus make them more desirable as mementos of special events;

(f) In an embodiment of the invention where an electrostatically-attached plastic film is laminated to the back of the name badge, permitting the easy removal of a safety pin or other finding without damaging the back of the name badge or the full-color/full-bleed graphic image produced there, the invention serves a temporary utilitarian function of name identification and a permanent function as a memento in the form of a personalized luggage tag or key fob.

The use of face-mounted full-color graphics to create laser-cut acrylic mementos with full-bleed images is a substantial improvement over all previously-disclosed methods and products, in part because of this invention's flexibility matches the shape of the mementos to irregular shapes of graphic images. The use of lens openings and clear, snap-in lenses in the exact size and shape of readily-available standard adhesive labels also is a substantial improvement over all previously-disclosed methods and products. The use of an electrostatically-adhered film coating on the reverse side of a name badge that contains a face-mounted vibrant image on both sides (with a label-size opening and lens on one side to accommodate real-time insertion of name identification) to facilitate the easy and non-damaging removal of a safety pin or other finding so that the memento can serve as a personalized key tag or luggage tag long after the conclusion of the event for which the name badge was utilized, is a substantial improvement over all previously-disclosed methods and products.

Another object of the invention is to provide a means of producing ready-to-hang "frames" that are, in fact, a combination "frame" and graphic artwork that also can be easily and inexpensively personalized. The use of face-mounted full-color graphics to create laser-cut acrylic mementos with full-bleed images in the form of ready-to-hang display plaques, awards, and photo frames that combine a vibrant graphic image with subsequently-inserted items, is a substantial improvement over all previously-disclosed methods and products. A preferred embodiment of the invention provides a backing board that serves as a mounting substratum for the photograph, concert ticket, sport-card, casino chip or other physical totem of remembrance, while at the same time serving as the hanging apparatus by which the product can be attached to a wall for display. The invention's snap-in clear acrylic lens protects and secures the photograph or other inserted item, and encapsulates and adds luster and vibrance to the same. The full-color/full-bleed graphic artwork that is face-mounted to the acrylic provides context for the totem of remembrance and enhances its display in a way that no prior frame has achieved.

Face-mounting a high-quality color print to a semi-rigid overlay of clear acrylic having a thickness dimension of between 0.05 in and 0.130 in adds vibrancy and luster to the images comprising the print because the acrylic captures light and creates a "depth" to the image, much as multiple coatings of polyurethane varnish adds luster to wood products.

The disclosed invention thus differs in several important respects from the prior art and all commercially-available display having frames or plaques predating the invention:

(a) Plaques produced using the invention may be personalized in full-color by the end-user in real time using inexpensive inkjet or laser printer technology and inexpensive and readily-available standard-size adhesive-backed labels that correspond to apertures that may be flexibly-located virtually anywhere within the surface of the graphic image;

(b) Such label-based personalization is combined with a transparent snap-in lens to encapsulate the label on the same plane as the face-mounted full-color graphic image, thus producing the same deep luster and vivid visual appearance for the personalized-label as exists for the corresponding graphic image, and thereby resulting in a visual effect that implies the personalized-label is an integral part of the surrounding image;

(c) Plaques produced using the invention result in photographic-quality full-color/full-bleed imagery of exceptional luster. The full-bleed characteristic of the invention means that the graphic images extend all the way to the outside boundaries of the particular embodiment, and do not need any surrounding border, mat, frame, or guide to orient the image, hold it in place, provide grip during manufacturing, etc. The full-bleed characteristic of the invention is made possible through the unique production sequencing disclosed herein and the face-mounting and laser-cutting techniques disclosed.

(d) The use of an optically-clear adhesive film, with a removable plastic film backing, to secure the lens in place over the personalization label inserted by the end user results in a bond that is much stronger than a mere mechanical snap-in lens could accomplish, thus making items produced using the invention more permanent and shock-resistant.

(e) The invention and the face-mounting technique provide flexibility such that the aperture may be cut out to correspond to the dimensions of various totems, or physical memorabilia of significance, such as ticket stubs, casino chips, and collectible sports cards, which may be fit into openings of a correspondingly precise size and shape, and secured under pressure to become integrated into the display plaque, with or without a transparent lens.

The methods, means, and embodiments comprising the invention constitute a material improvement as compared to all previously-described products in the prior art because the full-bleed graphic imagery of said mementos extends all the way to the perimeter of the objects, with no border being necessary as with less sophisticated techniques of printing images on rigid or semi-rigid surfaces (such as silk screening).

Various other features, objects and advantages of the invention will be made apparent from the following detailed description taken together with the drawings.

BRIEF DESCRIPTION OF THE DRAWINGS

The drawings illustrate the best mode currently contemplated of practicing the present invention.

In the drawings:

FIGS. 14A–E collectively illustrate the formation of the memento of FIG. 13.

DETAILED DESCRIPTION

Figure 1:
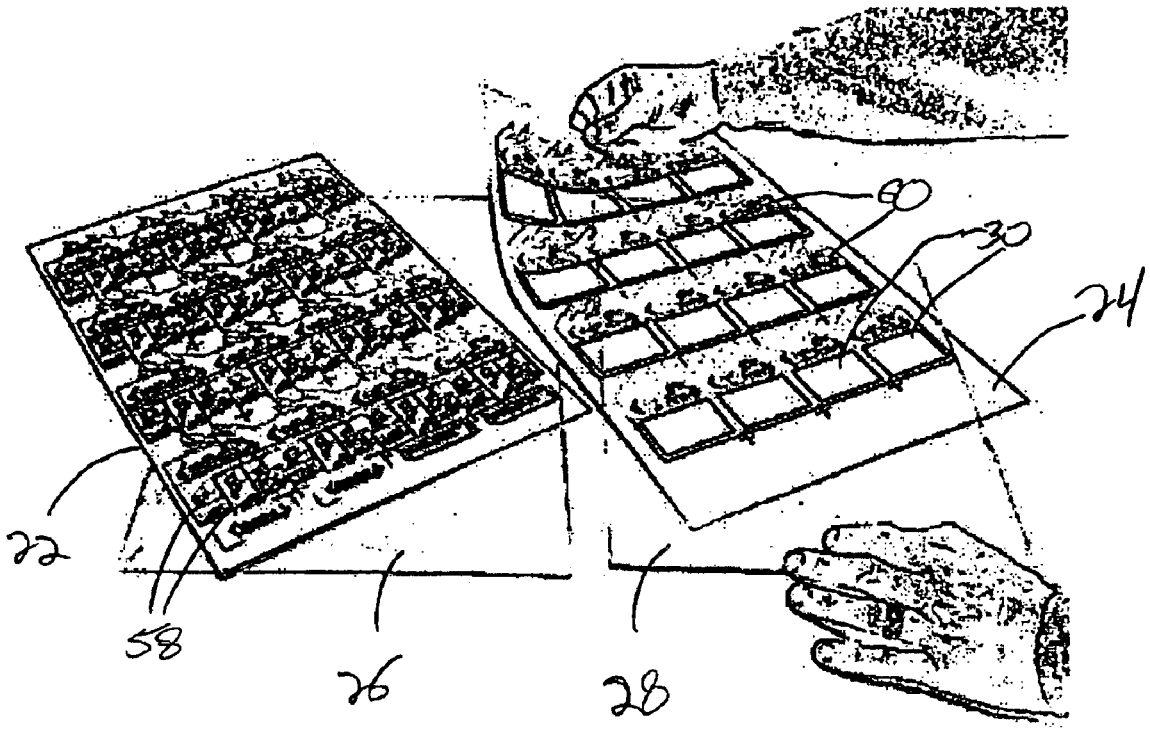
FIG. 1 is a perspective view of the basic elements used in forming a two-sided memento according to the present invention.

With reference now to the drawing Figures in which like reference numerals described like parts throughout the disclosure, FIG. 1 shows the basic elements involved in making a two-sided memento 20 according to the invention, namely, two graphic prints or lithographs 22 and 24 and two pieces of acrylic sheet 26 and 28 corresponding in size to the prints 22 and 24. (As used herein, the term "acrylic" also includes all other forms of rigid, optically clear plastics and similar materials, including, but not limited to, polycarbonate and PETG.) In a preferred embodiment, one of the graphic prints 24 is comprised of images 60 containing a void or unprinted area 30 that has dimensions similar to an adhesive-backed label or other insert of corresponding dimension.

The manufacturing methodology is initiated by generating the color graphic prints 22 and 24 on paper or some other flexible and ink-receptive medium using known computerized technology involving digital pixels. This technology permits short-run printing wherein the main images on the medium can be superimposed with an image comprising one or more logotypes for the special event, its venue, or its sponsors. The resulting rectangular print sheets 22 and 24 are thus typically comprised of a plurality of identical images 58 and 60, respectively, which themselves may be either geometrically or irregularly shaped.

Figure 2:
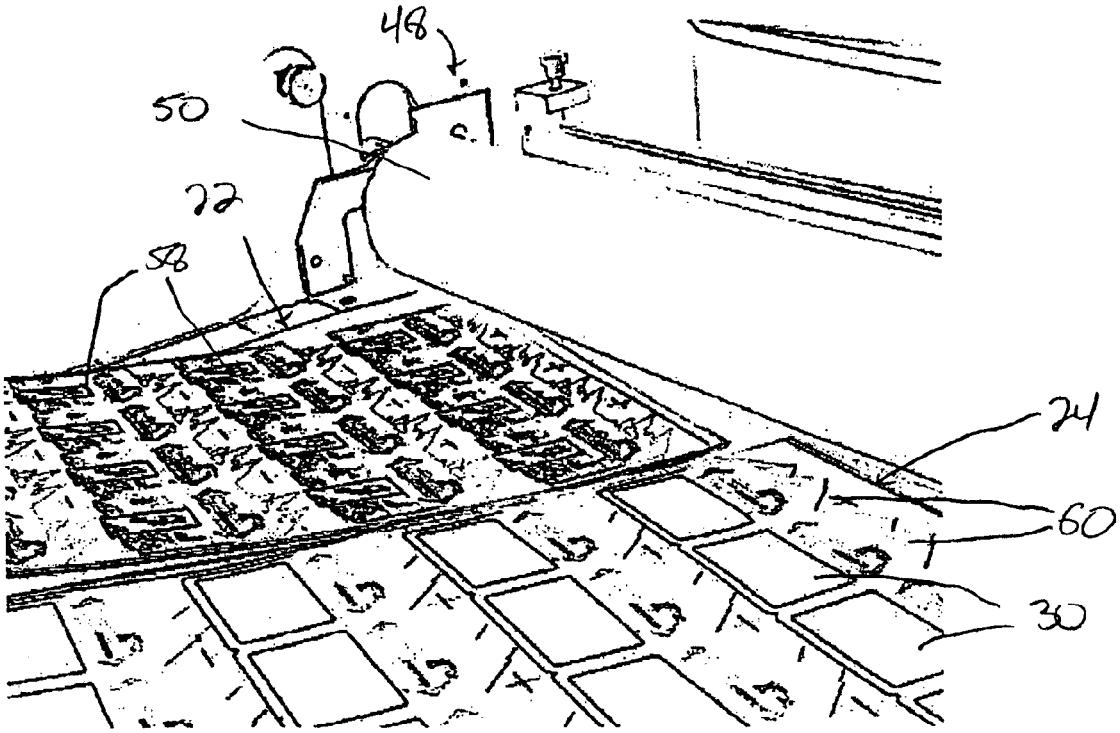
FIG. 2 is a perspective view of a lamination process used to form the elements into each half of the memento of FIG. 1.
Figure 2A:
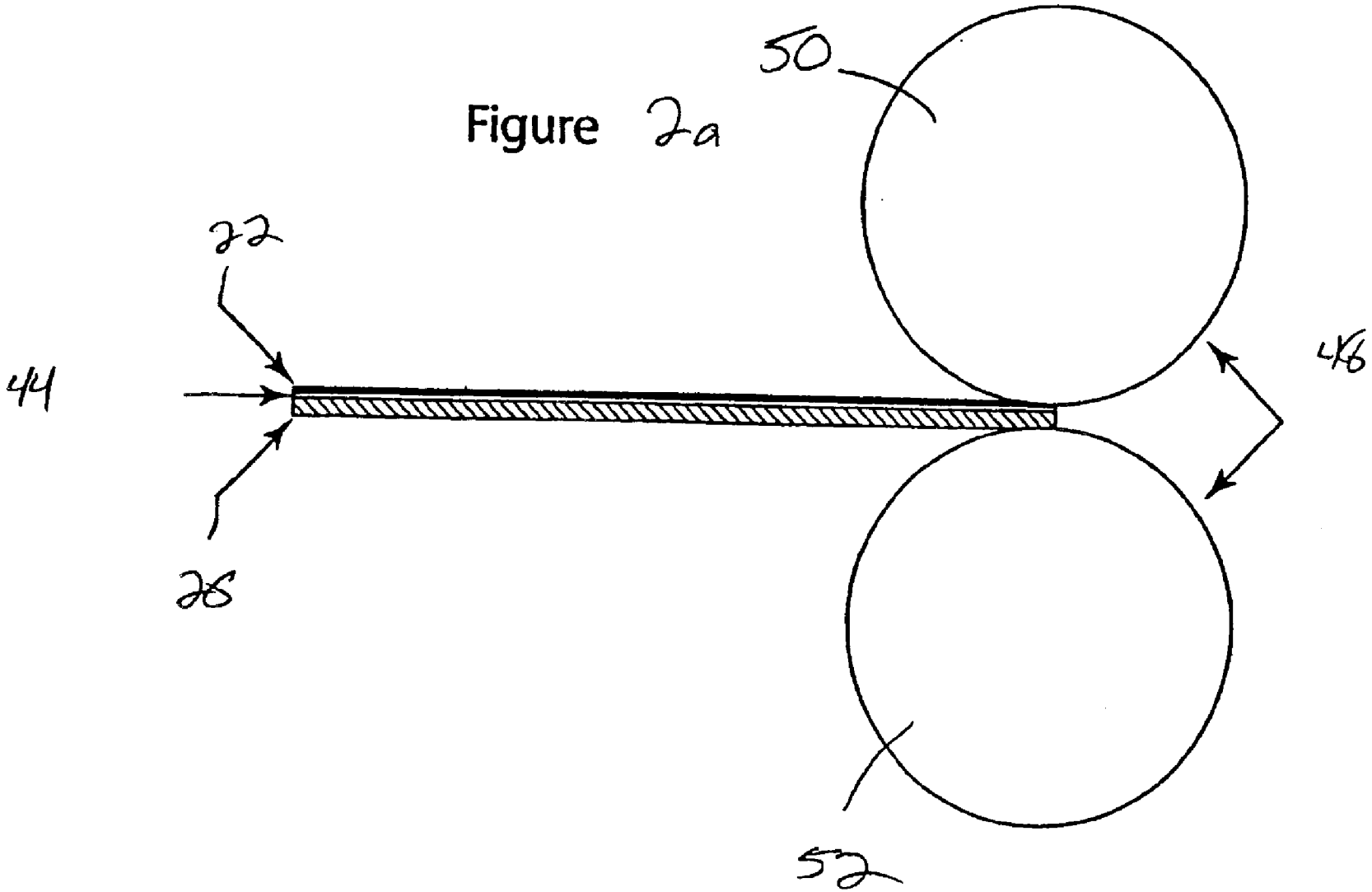
FIG. 2*a* is a schematic side view of the lamination of the elements into each half of the memento in FIG. 2.

As best shown in FIGS. 2 and 2*a*, the finished color graphic prints 22 and 24 are face-mounted under pressure to the clear acrylic sheets 26 and 28 using an optically-clear adhesive 44 so as to enhance the vibrance of the images 58 and 60. The term "face-mounted" is used and defined in contradistinction to the common-place or known method of mounting a graphic image printed on paper to a rigid or semi-rigid substrate for support and stability. Such common-place or known mounting involves the application of an adhesive 46 to the rear or back-side of the paper print 22 or 24, which then is pressed on to the substratum (not shown). When "face-mounted", the graphic print 22 or 24 is shielded "beneath" and visible through a clear super-stratum, such as the acrylic sheets 26 or 28, that is adhered to the face-side of the graphic 22 or 24 by the optically-clear adhesive 44. Absent the use of the optically-clear adhesive 44, face-mounting results in a degradation of the quality of images 58 and 60 on the graphic prints 22 and 24. But, when an optically-clear adhesive 44 is employed—such as that sold under the 3M brand as product "8141" or under the SEAL brand name "OptiMount"—and a clear acrylic sheet 26 or 28 is utilized as the super-stratum, the image quality and the vibrance of the colors of the graphic 22 or 24 actually are enhanced.

The sheets 26 and 28 of semi-rigid clear acrylic preferably have a thickness between 0.05" and 0.130" and width and height dimensions slightly larger than the associated rectangular prints 22 and 24, and are affixed as a super-stratum to each of the graphic prints 22 and 24 by interposing a thin film of optically-clear, two-sided adhesive 44, as discussed above, between the face of the graphics 22 and 24 and the clear acrylic super-stratum 26 and 28, respectively. A laminating machine 48 is then used to apply evenly distributed pressure to the prints 22 and 24 and the sheets 26 and 28 by passing the sheets 26 and 28, prints 22 and 24 and adhesive 44 between two rollers 50 and 52 on the machine 48 capable of applying adequate pressure to eliminate air bubbles and other imperfections between the prints and sheets.

Figure 3:
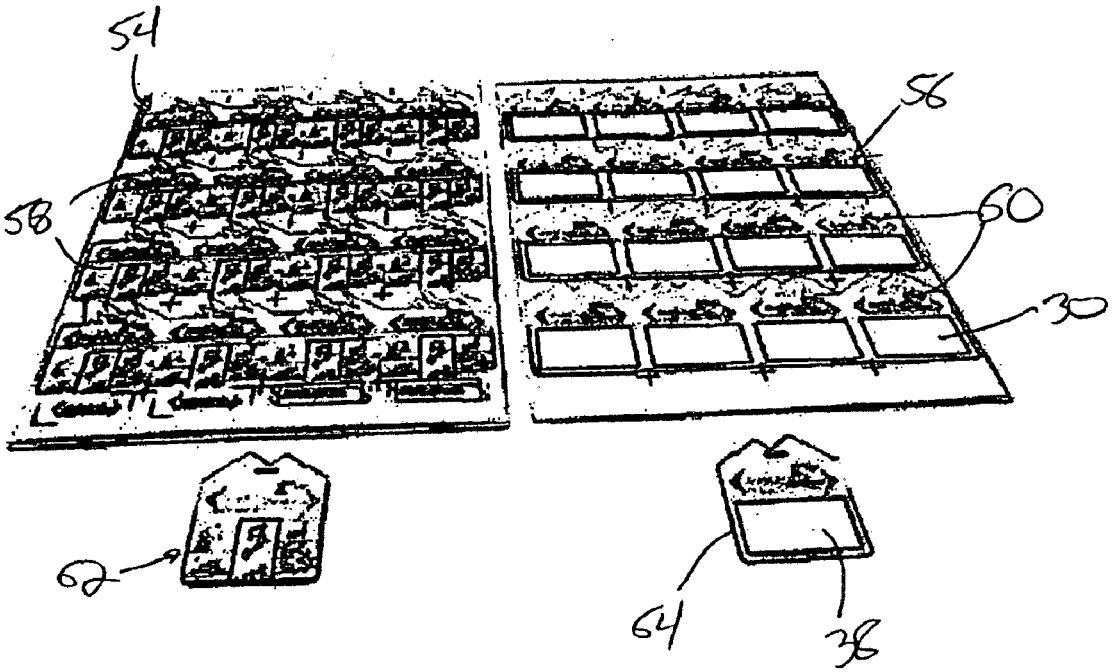
FIG. 3 is a perspective view of the basic elements adhered to one another to form each side of the memento of FIG. 2.
Figure 4:
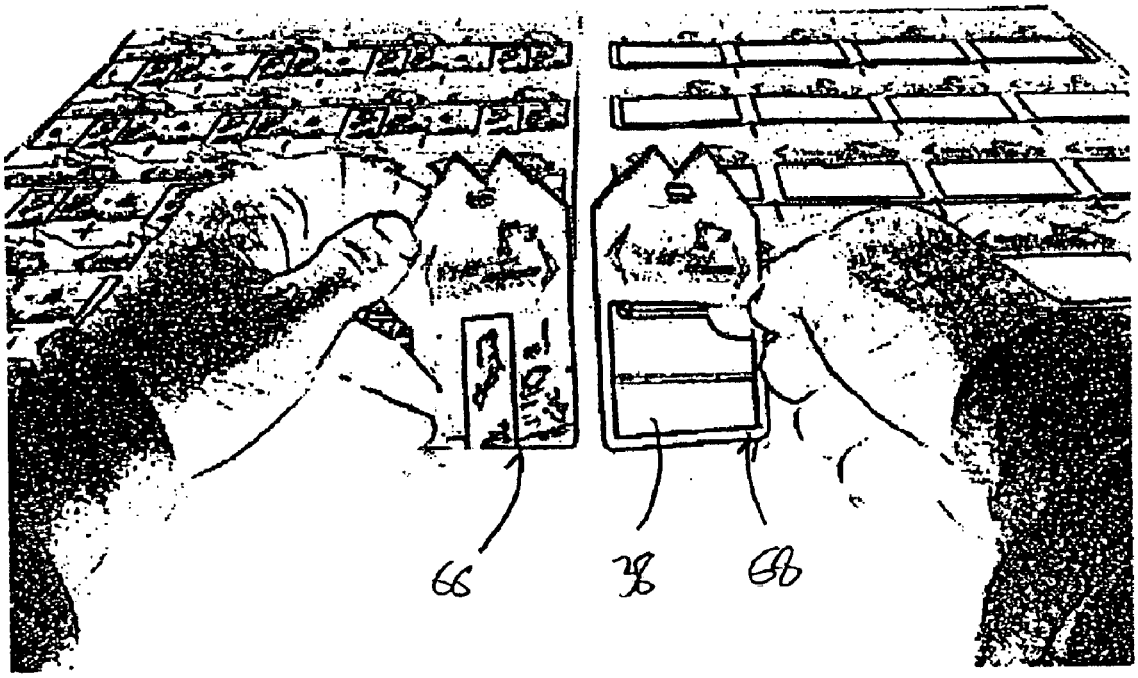
FIG. 4 is a perspective view illustrating the assembly of the halves of the memento of FIG. 3.
Figure 5:
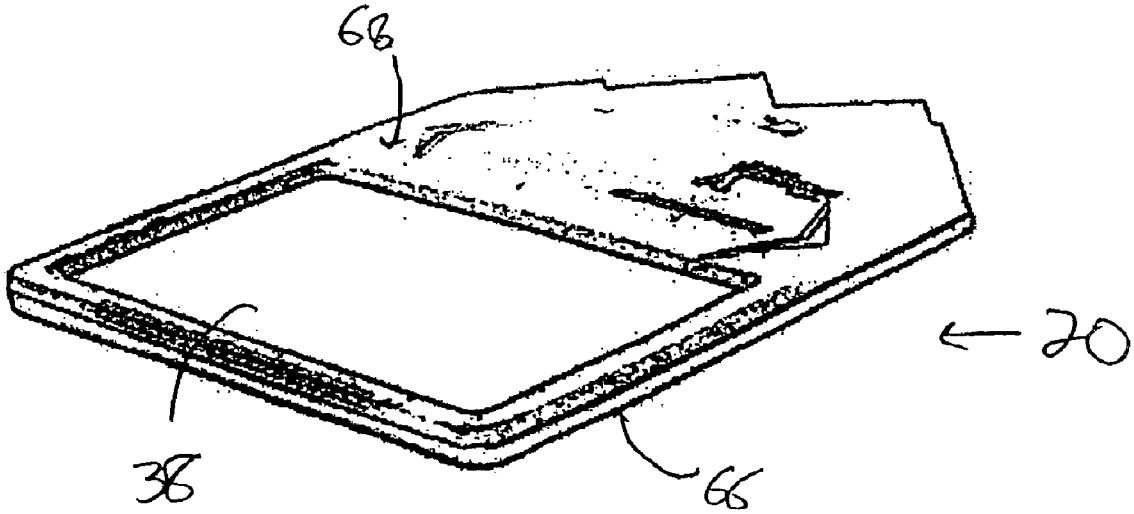
FIG. 5 is a perspective view of a completed memento.

Referring now to FIGS. 3–5, completion of the lamination process forms a pair of laminated boards 54 and 56 from the prints 22 and 24 and sheets 26 and 28. Each laminated board 54 and 56 is then transferred to a conventional computer 25 numerically-controlled laser cutting device (not shown). The cutting device circumscribes each of the individual images 58 and 60 of each graphic print 22 and 24 on each board 54 and 56, thus producing a plurality of full-bleed geometrically or irregularly shaped pieces 62 and 64 of the shape and size characteristic of the images 58 and 60 comprising the graphic.

Figure 9:
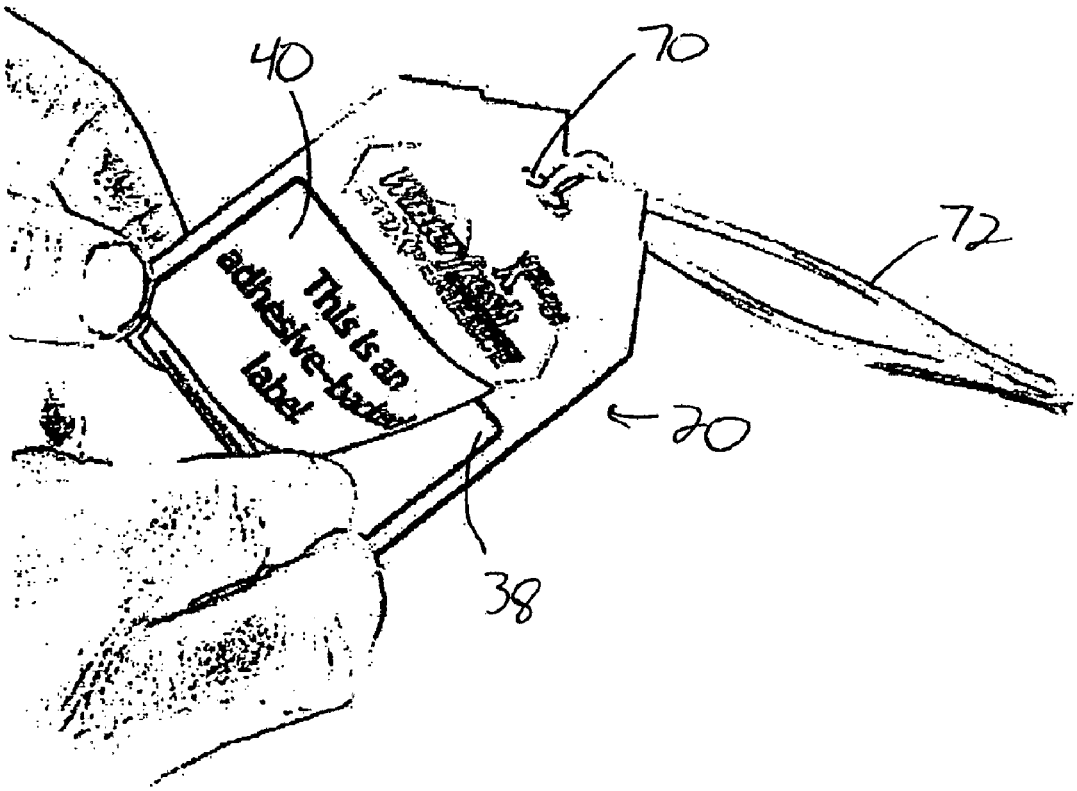
FIG. 9 is a perspective view of the attachment of an adhesive-backed label to the memento of FIG. 5.
Figure 10:
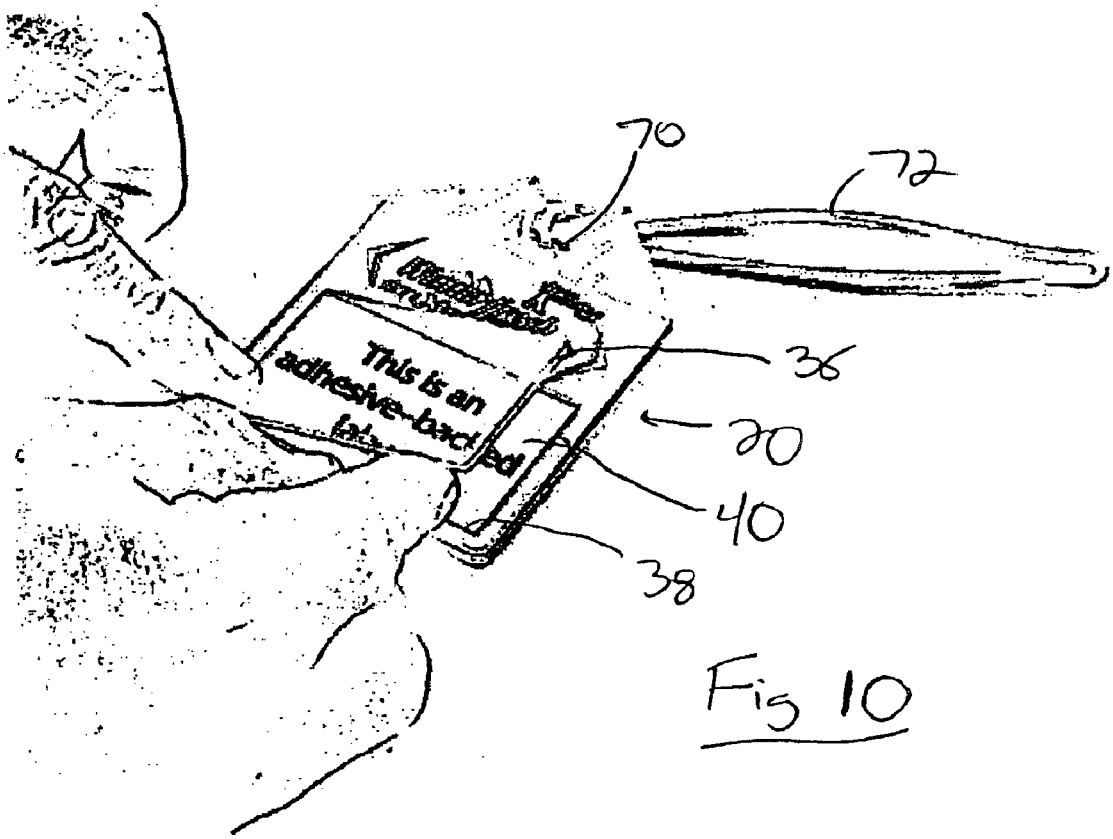
FIG. 10 is a perspective view of the attachment of a clear lens attached to the memento of FIG. 5.

In a preferred embodiment, the operator can also utilize the laser-cutting device to circumscribe in the piece 64 a cut out opening 38 that is exactly the same size and shape as the void 30 and as a standard adhesive-backed label that can be utilized by the consumer to customize or personalize the memento 20 by adding indicia to the memento 20 specific to a special event, location, or experience. (An exemplary label 40 is illustrated in FIGS. 9 and 10. Once the two pieces 62 and 64 of the same size and mirror-image shapes have been produced, they can be joined in a back-to-back configuration to comprise a single memento 20 in which the pieces 64 and 62 comprise a rear half 68 in which the label-size cut-out 38 has been circumscribed, and a front half 66 without the cut out, respectively.

Figures 6, 7:
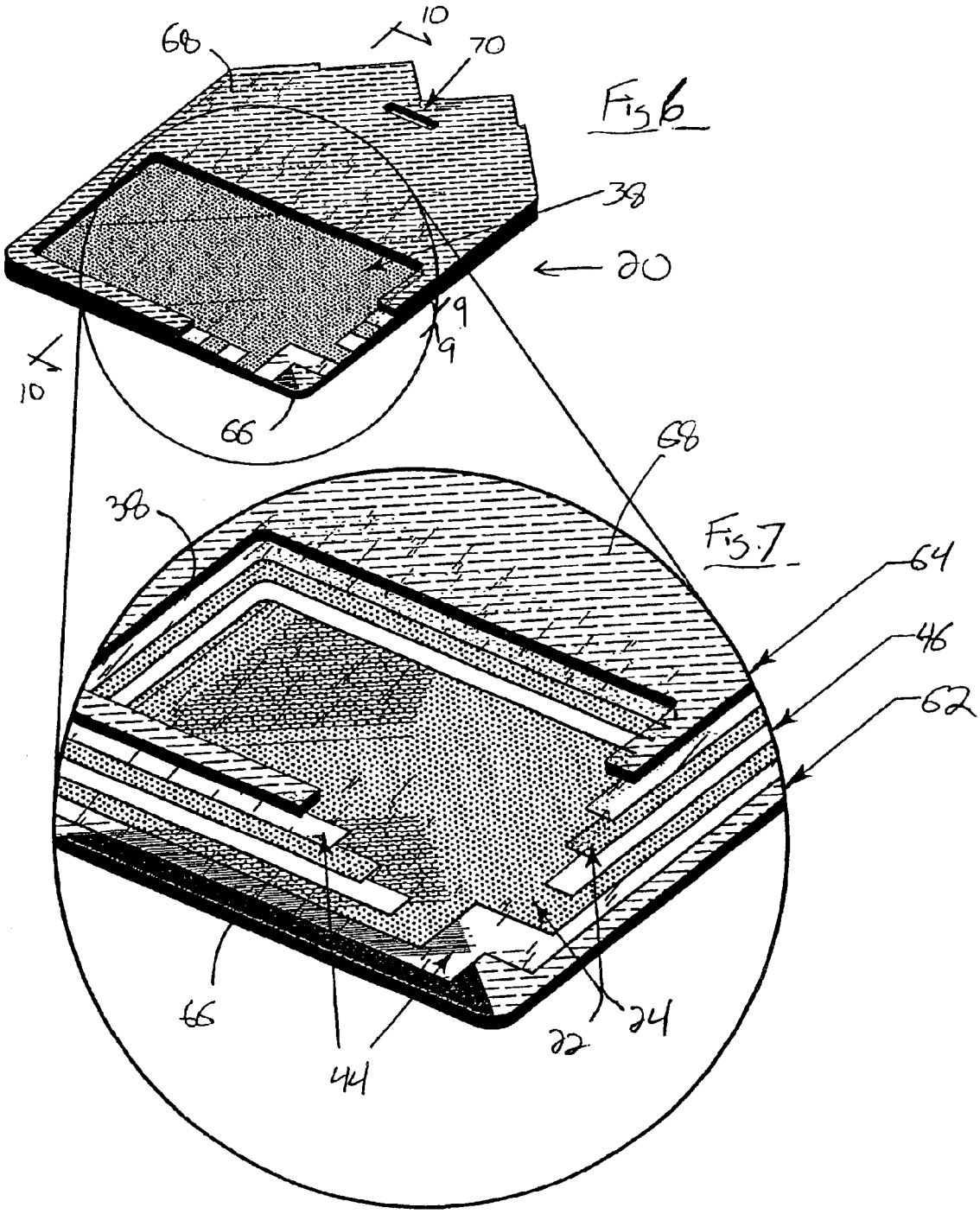
FIG. 6 is a partially broken away perspective view of the memento of FIG. 5.
FIG. 7 is a circular, exploded cross-sectional view along line 7—7 of FIG. 6.
Figure 8:
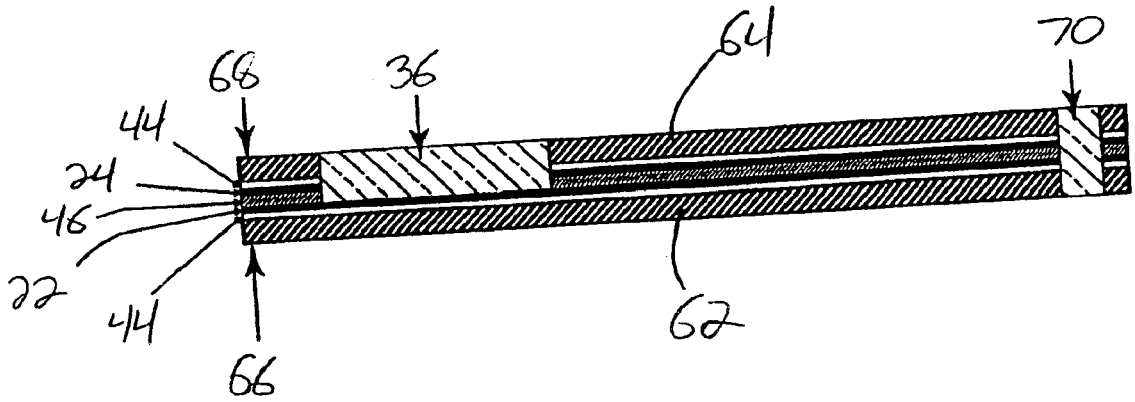
FIG. 8 is a cross-sectional view along line 8—8 of FIG. 6.

Looking now at FIGS. 6–8, the two halves 66 and 68 are joined by adhering the back of the print 22 on the front half 66 to the back of the print 24 on the back half 68 by means of a standard chemical adhesive or bonding agent 48. In a separate embodiment (not shown), the halves 66 and 68 can also be adhered to opposite sides of a substrate. The rear half 68 of the now-unified laminated memento 20 forms a backing board to which a standard label 40 with a pressure sensitive adhesive backing or the like can be adhered, after being printed with photographic images or other indicia by the consumer, as shown in FIG. 9. The edges of the cut out opening 38 in the front half 66 act as a guide for the insertion of the label 40.

Referring now to FIG. 10, a material component of the memento 20 of the present embodiment invention is a clear lens 36. The lens 36 may be formed of the same acrylic material utilized in producing the front half 66 and rear half 68 of the memento 20, as described above. The width and height dimensions of the lens 36 are slightly larger than the dimensions of the cut-out opening 38, so that the lens 36 snaps securely into place within the opening 38 after the label 40 is placed in the opening. One side of the lens 36 also may be coated with the optically-clear pressure sensitive adhesive 44 so that, once a protective mask (not shown) is removed therefrom, the adhesive 44 will act to hold the lens 36 securely in place over the top of the label 40 within the opening 38, thus effectively encapsulating the label 40 on approximately the same plane as the graphic print 24 comprising a part of the rear half 68.

Referring to FIGS. 6 and 8–10, the memento 20 also may include an opening 70 that extends through each of the halves 66 and 68 above the opening 38. The opening 70 can be formed by the laser cutter in each half 66 and 68 before the halves are joined, or by a separate process after the halves 66 and 68 are joined. The opening 70 allows the memento 20 to be attached to a strap 72 used to secure the memento 20 to another object (not shown) such as a golf bag or piece of luggage.

By utilizing known digital printing processes and database merging software, stock graphic images can be printed-over with logotypes, names, phrases, etc. in order to custormize the individual mementos 20 for specific events. In addition, the images 56 and 60 and graphics 22 and 24 can be oriented to facilitate easy on-the-spot customization, while displaying the images 58 and 60 in an attractive "full-bleed" format where the edges of the images 58 and 60 extend to the periphery of the mementos 20 without any border.

Figure 11:
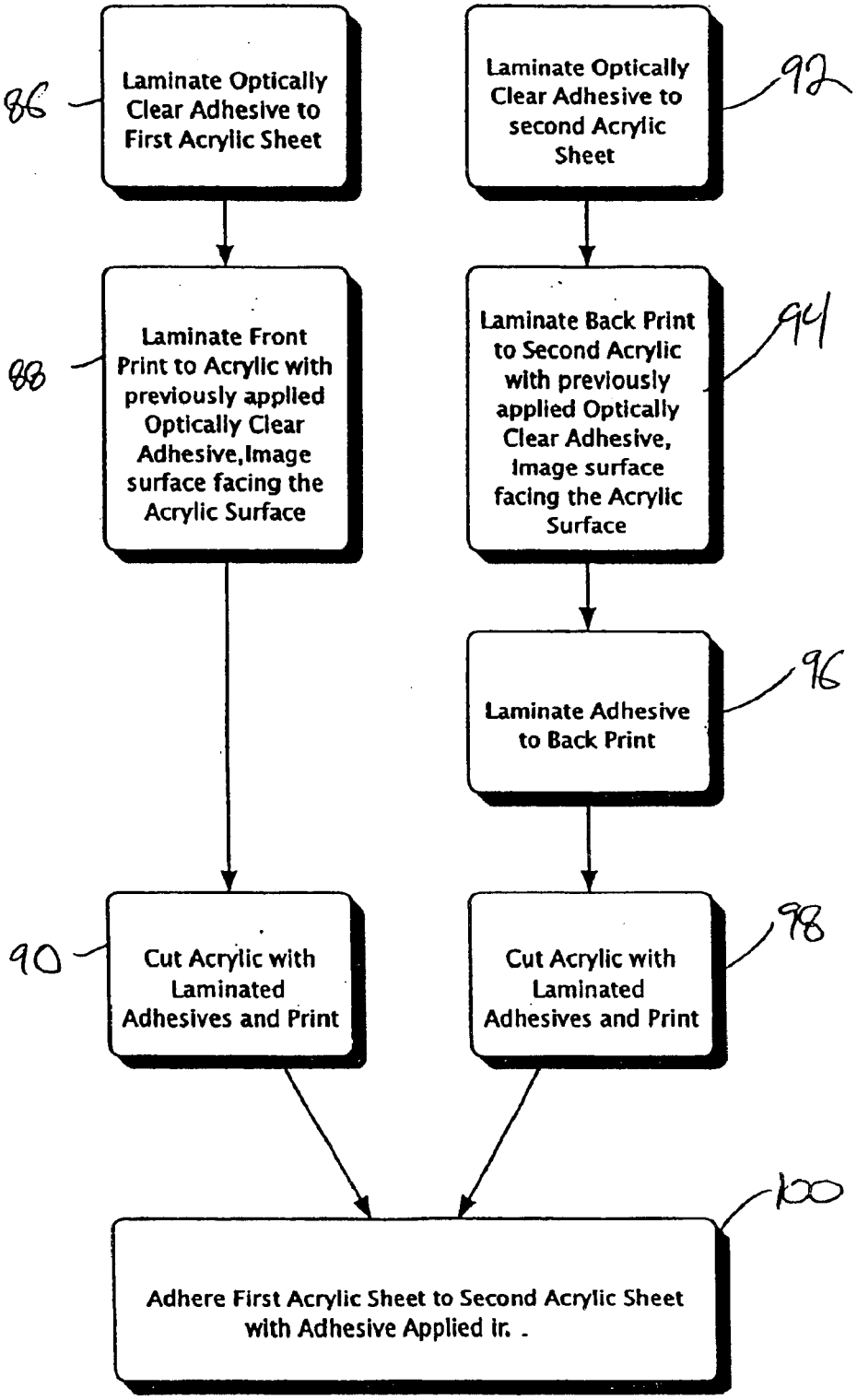
FIG. 11 is a flow chart schematically representing the steps and forming the memento of FIG. 5.

The method of forming the first preferred embodiment of the invention is schematically illustrated in FIG. 11. To form the front half 66, in block 86 the optically clear adhesive 44 is laminated on one side of the acrylic sheet 26. Thus, in block 88 the print sheet 22 is laminated to the acrylic sheet 26 by placing the image-containing side of the print sheet 22 against the optically clear adhesive 44, or "face-mounting" the print sheet 22. Next, in block 90 the acrylic sheet 26 is cut by a suitable device, such as laser cutter, in order to separate the individual images 58 on the print sheet 22 from one another to form a plurality of front halves 66.

While the front halves 66 are being created, each rear half 68 is simultaneously formed by placing the optically clear adhesive 44 on the acrylic sheet 28 in block 92. The acrylic sheet 28 is then joined with the print sheet 24 in block 94 to allow the optically clear adhesive 44 to secure the print sheet 24 to the acrylic sheet 28. The conventional adhesive 46 is then placed on the print sheet 24 opposite the acrylic sheet 28 in block 96, and in block 98 each rear half 68 is cut from the acrylic sheet 78 using the laser cutter to separate the individual images 60 from the print sheet 24. In this step, the cut-out opening 38 can also be formed to allow the label 40 or other customizable element to be positioned within the cut-out opening 38. The lens 36 can be formed in a separate step by forming an acrylic piece (not shown) into the desired shape, or by using the portion of the acrylic sheet 28 removed from each rear half 68.

After the front half 66 and rear half 68 have been formed as described previously, in block 100, the front half 66 is secured to the rear half 68 by contacting the non-image side of the first print 22 with the adhesive 46 on the rear half 68.

Figure 12:
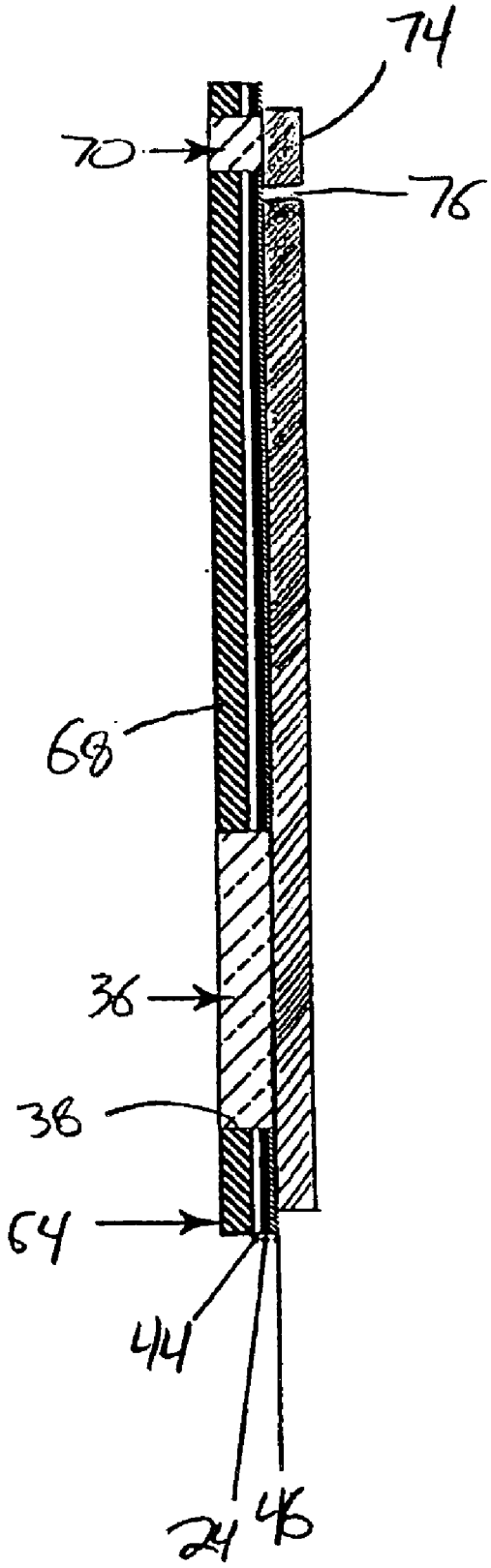
FIG. 12 is a cross-sectional view of a memento according to a second embodiment of the invention.
Figure 13:
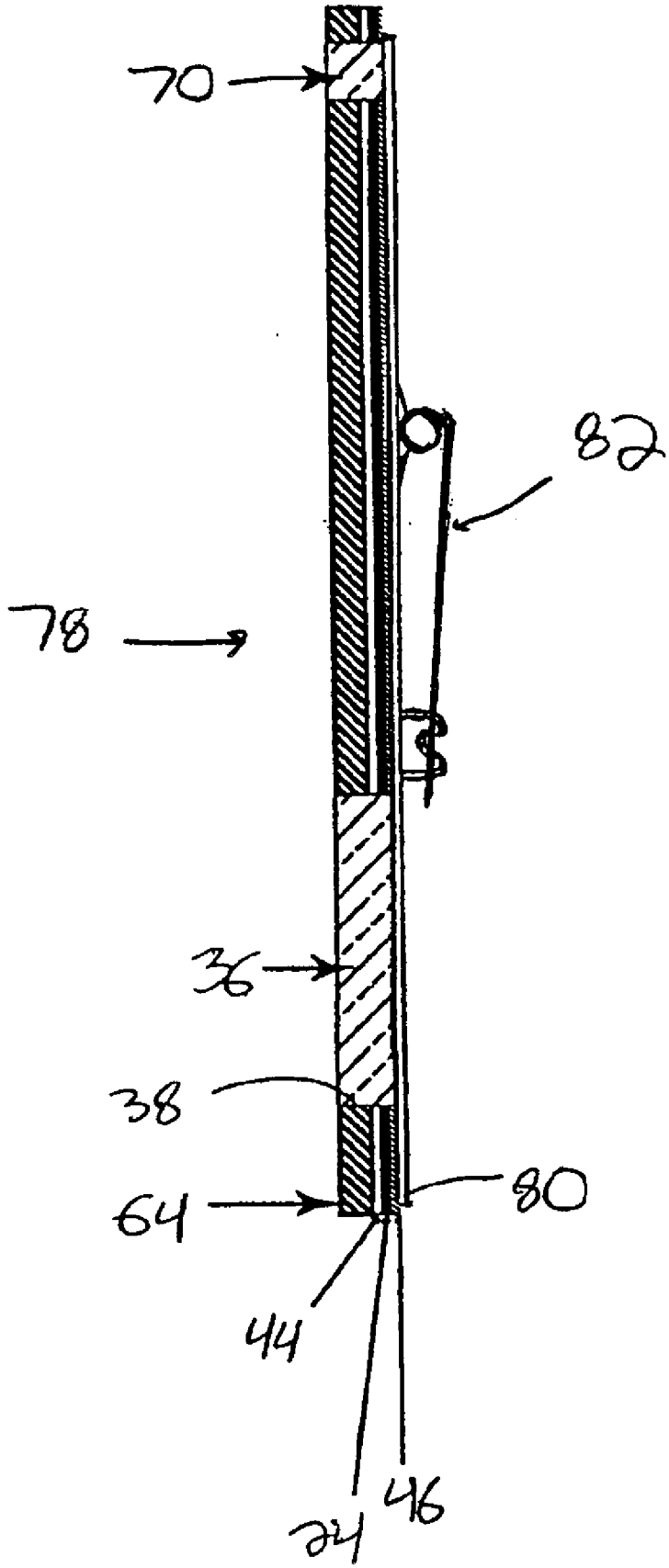
FIG. 13 is a cross-sectional view of a memento according to a third embodiment of the invention.

In another preferred embodiment of the invention, shown in FIG. 12, the memento 20 is formed to be used as an award plaque, in which the front half 66 of the memento 20 is removed and replaced with a backing member 74. The backing member 74 is preferably between 0.125 and 0.25 inches thick, with a length and width approximately 0.25 inches smaller than the rear half 68. The backing member 74 is formed of a rigid material, such as wood, particle board, melamine, medium density fiber board, fiber board, hard board, masonite, foam backer board or the like. The backing member 74 includes a slot 76 that is positioned opposite the rear half 68 and is adapted to receive a nail or other element (not shown) that extends outwardly from a wall in order to hang the backing member 74 and memento 20 from the wall. In this manner, the memento 20 can be formed to constitute a plaque or other award suitable for display on a wall.

A third preferred embodiment of the invention, shown in FIGS. 13 and 14A–E, is a name badge 78 formed with the rear half 68, described previously, and a releasable film 80 in place of the front half 66. The film 80 is electrostatically laminated onto or otherwise releasably secured to the front of the rear half. The badge 78 is convertible to a key fob or luggage tag through the removal of the film 80 initially adhered to the back surface of the badge 78, thus allowing a finding 82, such as a safety pin, a magnetic button, or a spring-biased clip or hook and loop closure, to be attached to the film 80 for the purpose of attaching the name badge to the clothing of the identified person. The film 80 adheres to the badge 78 in such a manner that it and the finding 82 may be removed from the badge 78 without damaging the back surface of the badge 78 or defacing the image 60 apparent there. After the film 80 is removed, a strap (not shown) can be inserted through the opening 70 to enable the badge 78 to be used in another capacity.

Figure 14A:
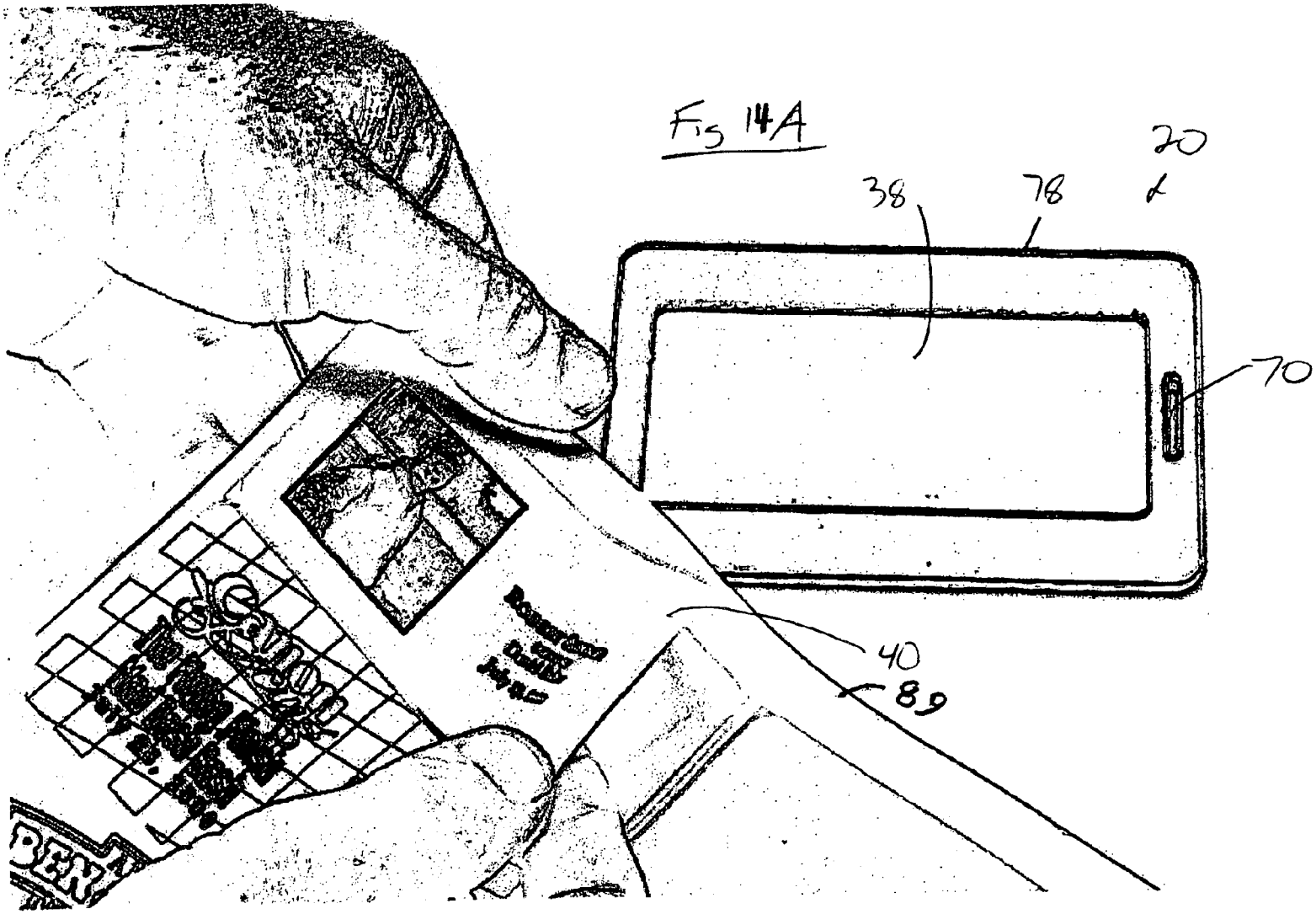
Figure 14B:
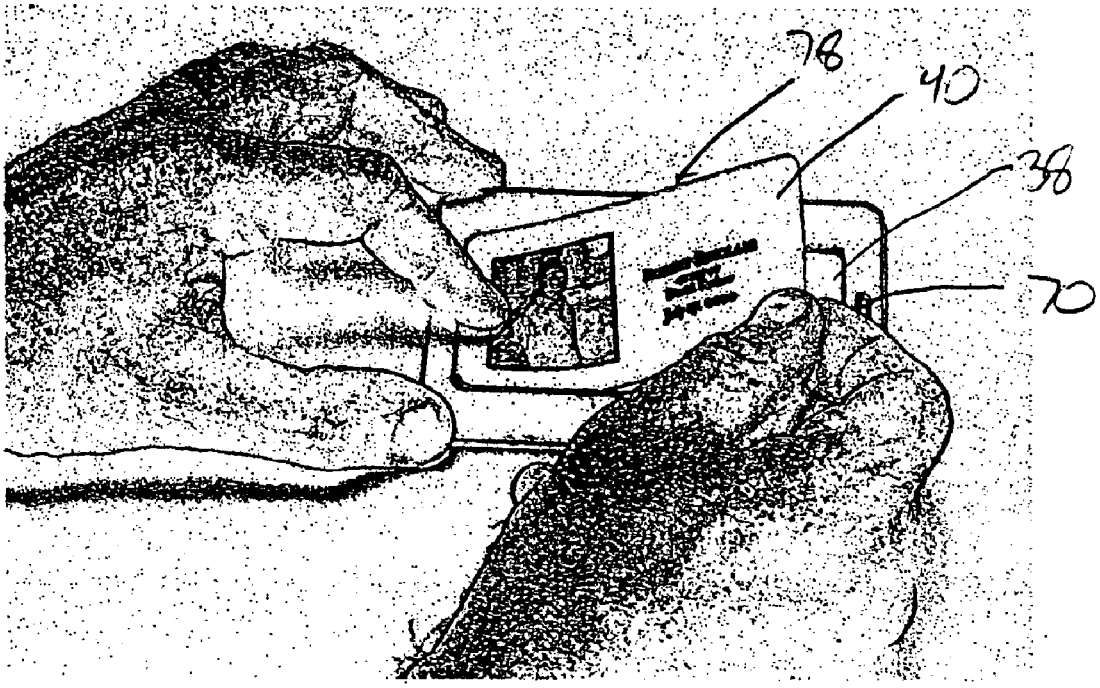
Figure 14C:
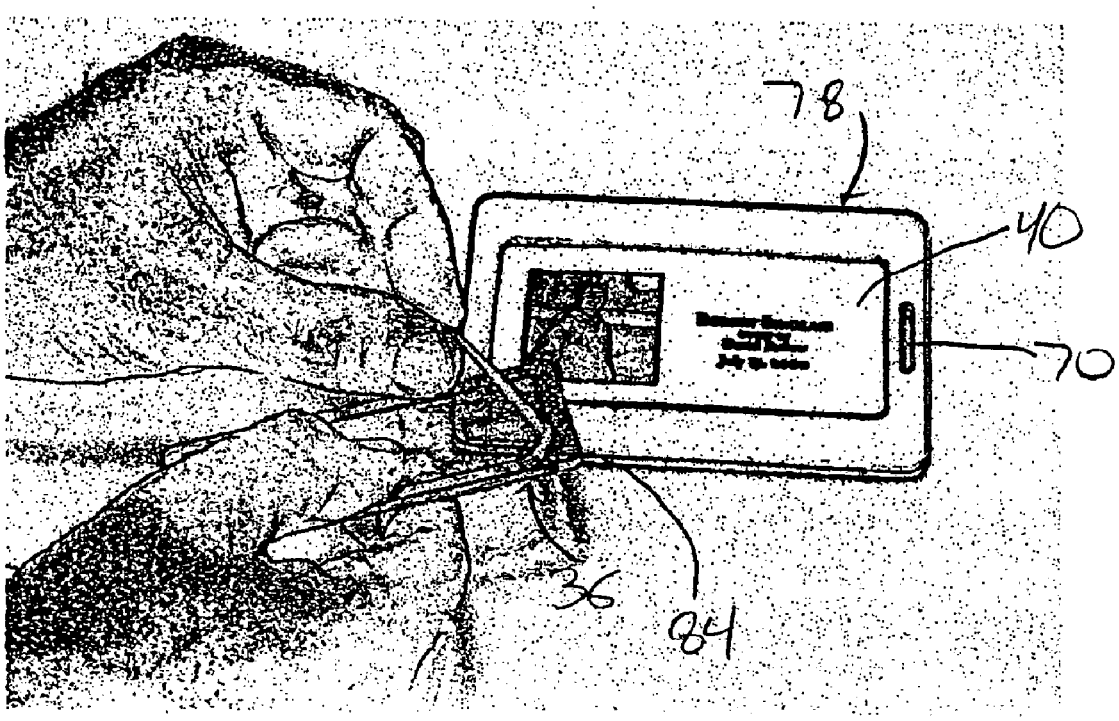
Figure 14E:
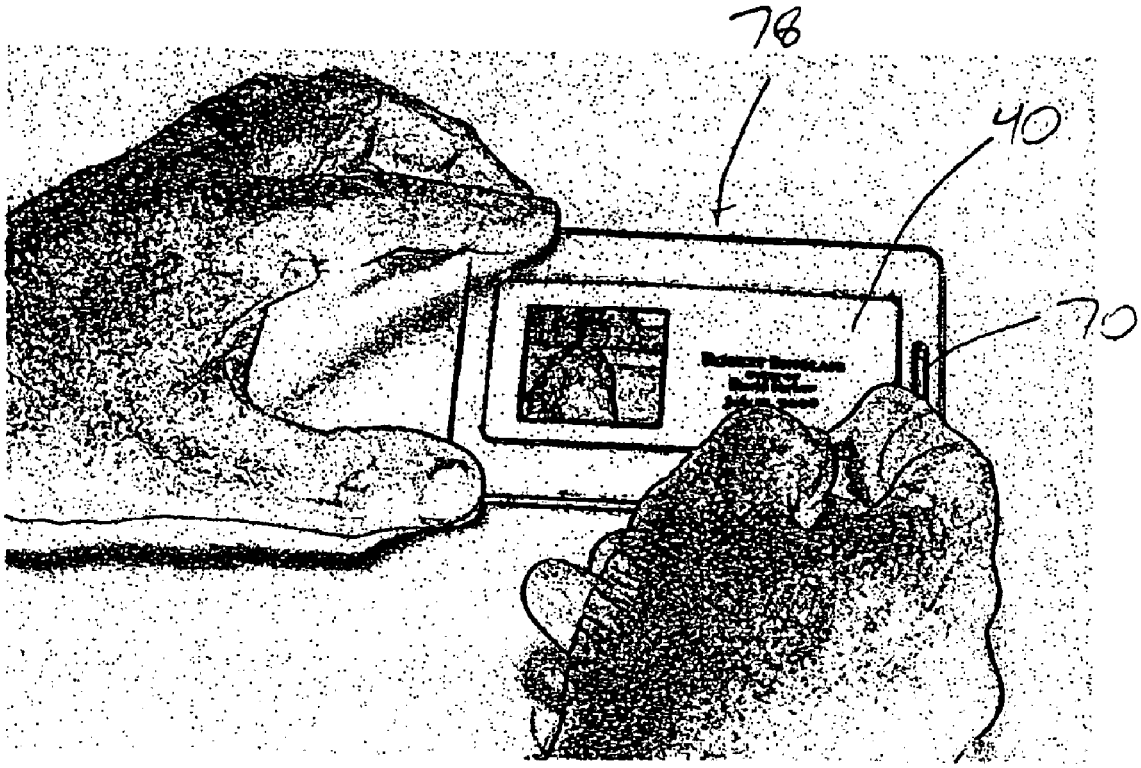

FIGS. 14A–E illustrate the attachment of a label 40 to the badge 78 in order to personalize the badge 78. In FIG. 14A a badge 78 is shown including an opening 38 in which the label 40 can be positioned. FIG. 14B illustrates the removal of a label 40 including the desired graphic material from a suitable substrate 89 in order to apply the label 40 to the badge 78 and the positioning of the label 40 within the opening 38 in the badge 78. The label 40 is then adhered to the opening such that the label 40 completely covers the opening 38. In FIGS. 14C–E, a lens 36 including a peripheral backing 84 formed with the optically clear adhesive 44 is positioned within the opening 38 over the label 40. The lens 36, by means of the adhesive 44, adheres to the label 40 and protects the graphic material on the label 40 while the badge 78 is in use.

In each of the above-described preferred embodiments, depending on the particular use for the memento 20, the label 40 positioned within the opening 38 can be a label, a card, a photograph, a scorecard, a certificate and a casino chip, among others. For example, when the memento 20 is used as a golf bag tag, the memento 20 can display photographic images of the course where an outing, tournament, or charity fundraising event is conducted, possibly combined with a graphic display of the course layout, wherein the print image contains a depiction of the logo of the corporate or charitable sponsor of the event, and an opening specifically sized to fit a standard adhesive-backed label is utilized to customize the memento in real time with the player's name and other indicia relevant to the event.

Various alternatives are contemplated as being within the scope of the following claims, which particularly point out and distinctly claim the subject matter regarded as the invention.

We claim:

1. A customizable memento comprising;

a first graphic print having a first face that bears an image;

a first optically clear overlay having an opening formed therein;

a lens insertable into the opening in the overlay; and an optically clear adhesive fixing the first face of the first graphic print to the overlay.

2. The memento of claim 1, further comprising:

a backing member formed of a rigid material; and a second adhesive fixing the backing member to a second face of the first graphic print opposite the first face.

3. The memento of claim 2, wherein the backing member has a slot formed therein that enables the backing member to be mounted to a wall.

4. The memento of claim 3, wherein the backing member is formed of a rigid material selected from the group consisting of: wood, particle board, melamine, fiber board, hard board, masonite, and foam backer board.

5. The memento of claim 2, wherein the optically clear adhesive is a first layer of the adhesive, and the backing member is formed of a second graphic print affixed to a second optically clear overlay by a second layer of the optically clear adhesive.

6. The memento of claim 1, wherein the optically clear adhesive is a first layer of the adhesive and the first graphic print bears images on both the first face and a second face opposite the first face, and wherein the memento includes a second overlay affixed to the second face of the first graphic print by a second layer of the optically clear adhesive.

7. The memento of claim 1, wherein the first overlay is formed from an optically clear material selected from the group consisting of: acrylic, polycarbonate and PTEG.

8. The memento of claim 1, wherein the opening is adapted to receive an item that can be covered by the lens.

9. The memento of claim 8, wherein the item is selected from the group consisting of: a label, a card, a photograph, a scorecard, a chip, and a certificate.

10. The memento of claim 8, wherein the lens has dimensions slightly larger than corresponding dimensions of the opening.

11. The memento of claim 10, wherein the lens is adapted to be fixed within the opening over the item by an optically clear adhesive.

12. The memento of claim 1, wherein the first overlay has a slot formed therein that is adapted to receive a strap that secures the memento to a separate object.

13. The memento of claim 1, further comprising an attaching member releasably attached to the memento opposite the first overlay.

14. The memento of claim 13 wherein the attaching member is fixed to a film that is releasably attached to the first graphic print.

15. The memento of claim 13, wherein the attaching member is selected from the group consisting of: a safety pin, a magnetic finding, a spring biased clip, and a hook and loop closure.

* * * * *